United States Patent [19]

Hartung et al.

[11] Patent Number: 4,785,733

[45] Date of Patent: Nov. 22, 1988

[54] ARRANGEMENT IN PRINTING MACHINES WITH ADJUSTMENT MEANS FOR CIRCUMFERENTIAL, AXIAL AND DIAGONAL REGISTER

[75] Inventors: Winfried Hartung, Offenbach am Main; Valentin Gensheimer, Muhlheim/Main, both of Fed. Rep. of Germany

[73] Assignee: M.A.N.-Roland Druckmaschinen, Offenbach am Main, Fed. Rep. of Germany

[21] Appl. No.: 151,986

[22] Filed: Feb. 3, 1988

[30] Foreign Application Priority Data

Feb. 10, 1987 [DE] Fed. Rep. of Germany ..... 3703998

[51] Int. Cl.[4] ..... B41F 13/14; B41F 5/06

[52] U.S. Cl. ..... 101/181; 101/248; 101/DIG. 12

[58] Field of Search ..... 101/181, 248, 415.1, 101/DIG. 12, 183

[56] References Cited

FOREIGN PATENT DOCUMENTS 3136704 3/1983 Fed. Rep. of Germany .

*Primary Examiner*—J. Reed Fisher

[57] ABSTRACT

In a printing machine having means for adjusting the circumferential, axial and diagonal register of a plurality of plate cylinders on which printing plates are secured, wherein each plate cylinder is mounted on a shaft for rotation and each printing plate has register markers disposed thereon outside of its respective printing and inking zone, the improvement comprising: a register marker detection system comprising at least one illuminating means disposed on one side of each plate for generating and projecting light to illuminate said register markers; at least one photo-detecting means disposed on the other side of each plate for periodically detecting said light projecting through the register markers as the cylinder rotates the printing plate and for generating measurement signals in response thereto; and circuit means connected to said photo-detecting means for generating signals to control said cylinder register adjustment means; said register markers comprising at least first and second accurate-register apertures; and said illuminating means and said photo-detecting means being positioned such that the light generated by said illuminating means is detected by said photo-detecting means after passing through said apertures.

21 Claims, 7 Drawing Sheets

FIG. 1A
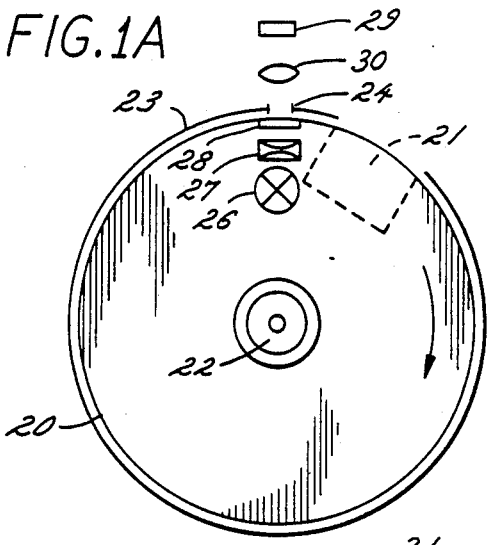
FIG. 1B
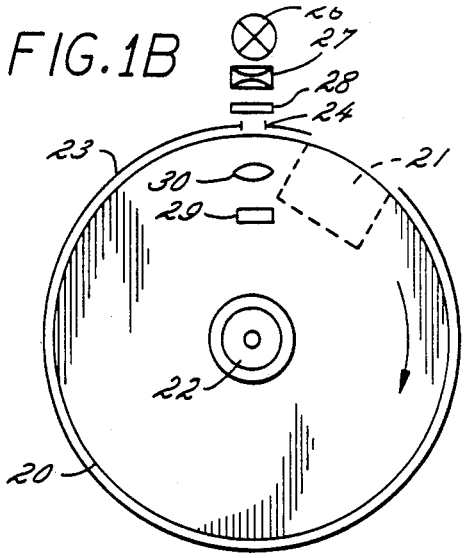
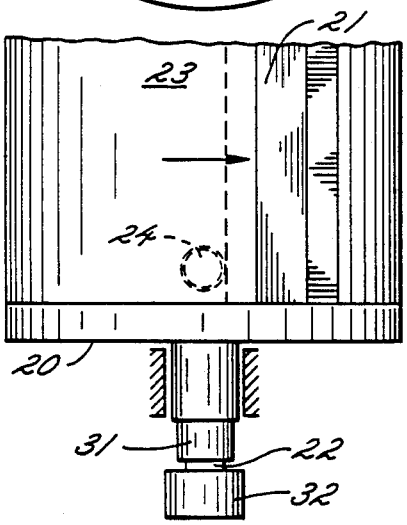
FIG. 2
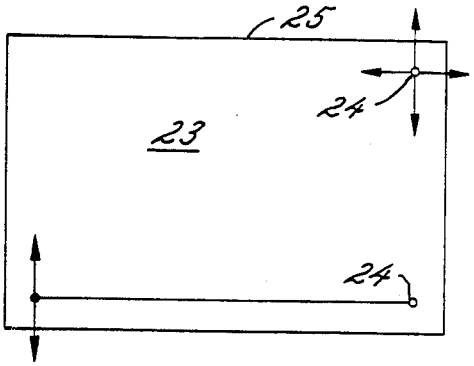
FIG. 3A
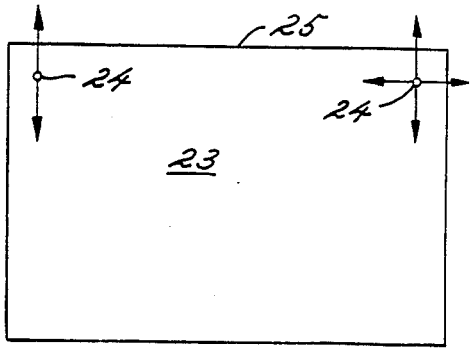
FIG. 3B

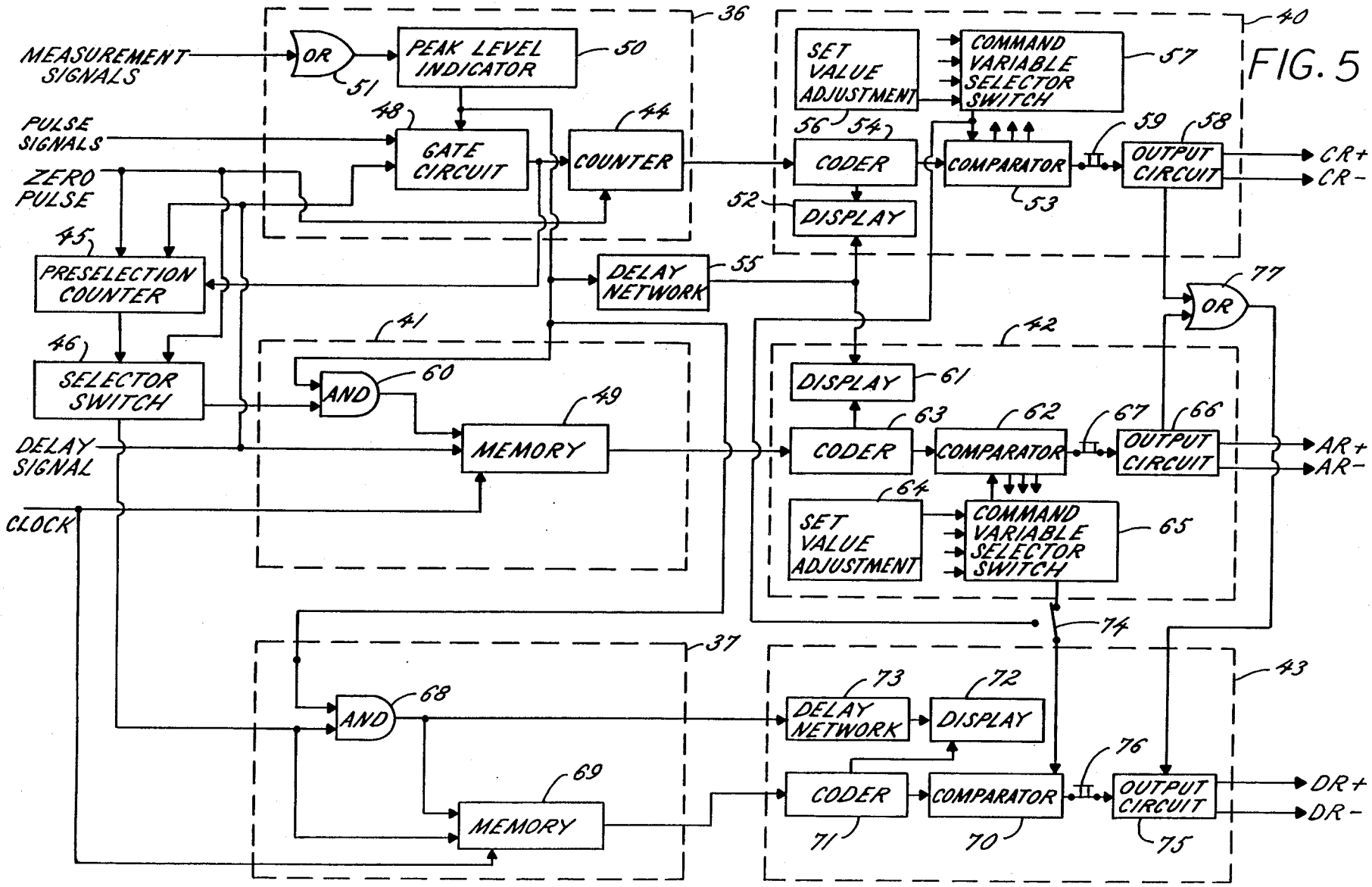
FIG. 5
40
CR+
CR-
OUTPUT CIRCUIT
58
59
57
COMMAND VARIABLE SELECTOR SWITCH
COMPARATOR
53
SET VALUE ADJUSTMENT
56
54
CODER
DISPLAY
52
77
OR
AR+
AR-
42
66
OUTPUT CIRCUIT
67
62
COMPARATOR
65
COMMAND VARIABLE SELECTOR SWITCH
61
DISPLAY
63
CODER
64
SET VALUE ADJUSTMENT
43
DR+
DR-
OUTPUT CIRCUIT
75
76
74
COMPARATOR
70
72
DISPLAY
73
DELAY NETWORK
CODER
71
36
PEAK LEVEL INDICATOR
50
OR
51
GATE CIRCUIT
48
COUNTER
44
DELAY NETWORK
55
41
AND
60
MEMORY
49
37
AND
68
MEMORY
69
MEASUREMENT SIGNALS
PULSE SIGNALS
ZERO PULSE
PRESELECTION COUNTER
45
SELECTOR SWITCH
46
DELAY SIGNAL
CLOCK MEASUREMENT SIGNALS
PULSE SIGNALS
ZERO PULSE
DELAY SIGNAL
CLOCK
PEAK LEVEL INDICATOR
GATE CIRCUIT
COUNTER
DELAY NETWORK
MEMORY
AND
OR
SET VALUE ADJUSTMENT
CODER
DISPLAY
COMMAND VARIABLE SELECTOR SWITCH
COMPARATOR
OUTPUT CIRCUIT
CR+
CR-
AR+
AR-
DR+
DR-
LINE PHOTO SENSOR

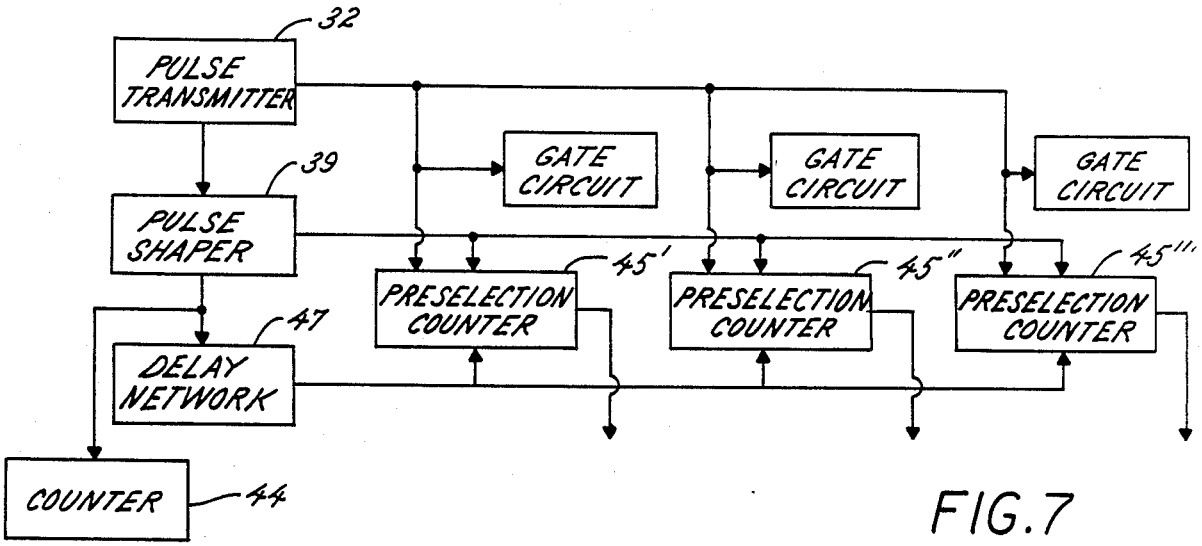
FIG.7
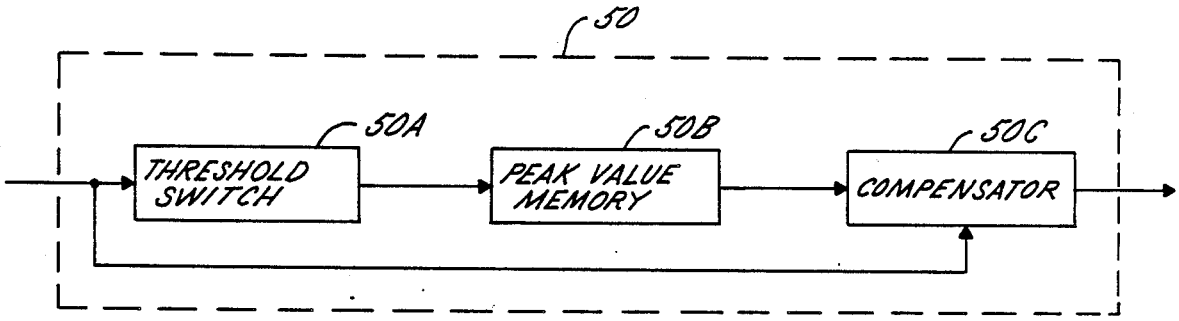
FIG.8
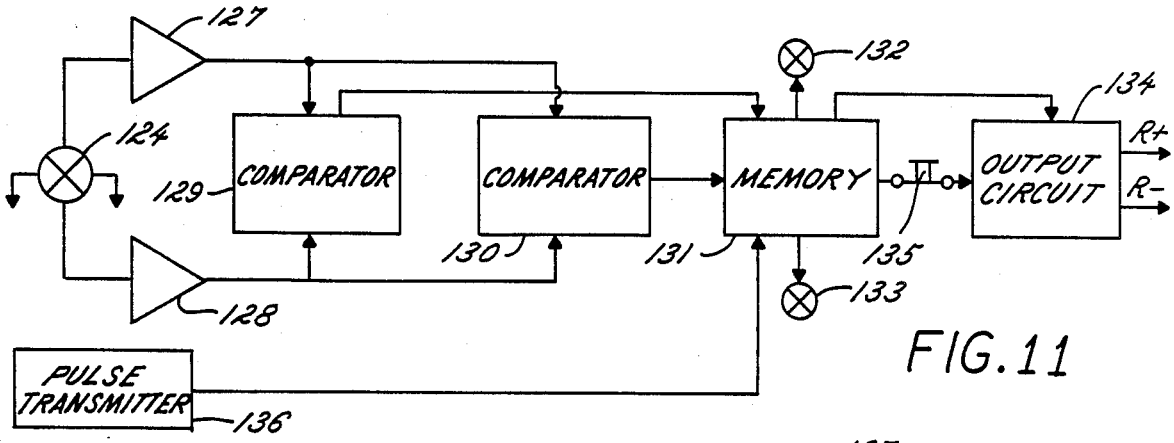
FIG.11
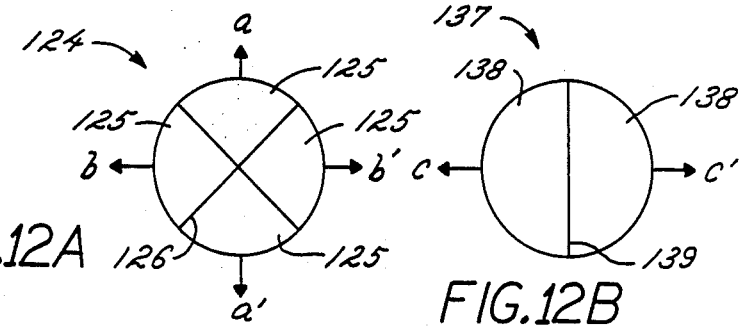
FIG.12A
FIG.12B

ARRANGEMENT IN PRINTING MACHINES WITH ADJUSTMENT MEANS FOR CIRCUMFERENTIAL, AXIAL AND DIAGONAL REGISTER

TECHNICAL FIELD

The present invention relates generally to printing machines, and, more particularly, to an arrangement for detecting and adjusting the circumferential, axial and diagonal register of the plate cylinders on which the printing plates are mounted.

BACKGROUND ART

As is well known, a printing machine has a plurality of successive plate cylinders each of which carries a printing plate. Typically, each printing plate is used to print a different primary color so that as a sheet of paper has superimposed images transferred to it by the succession of plates, a multi-color image is produced. In order to produce a sharp multi-color image, the successive plate cylinders must be positioned with respect to each other so that the plates are in a predetermined relative alignment (i.e., in register).

Arrangements for adjusting the register of plate cylinders have been previously described in various publications (e.g., DE-PS 3,136,703, DE-OS 3,136,704, DE-OS 3,302,200, DE-OS 3,535,579 and JP-PS 55-25062/1980). Generally, these known arrangements comprise a reflex register marker detection system for each plate cylinder, i.e., a light source, reflecting markers (e.g., line markers in the form of registration crosses or stamped-out apertures on the printing plates) and a photo-receiver, with the light source and receiver being positioned on the same side of the printed sheet to illuminate the marker by means of the source and to detect reflected light by the receiver. Each system delivers a measurement signal scanned by the reflex scanning system or the like from the reflecting markers, and the measurement signal is used to generate control signals for adjusting the register of the plate cylinder. Such reflex scanning systems are acceptable, but their accuracy depends greatly on the quality of the marker edges and contrast since the reflecting markers are scanned in the form of shadows in the bright surrounding field of the photo-receiver.

SUMMARY OF THE INVENTION

It is a primary object of the present invention to depart from the evaluation of reflecting line markers (i.e., evaluation of a shadow in a bright surrounding field), and instead to evaluate a spot of light in a darkened surrounding field of a photo-receiver, such evaluation being comparatively independent of contrast and edge quality.

It is a further object of this invention to provide a register marker detection system wherein light markers of constant brightness are scanned so that signals of constant amplitude are delivered, and so that edge zone influence is minimal compared with the full surface.

Another object of this invention is to provide a register marker detection system which enables greater scanning accuracy for the same expenditure as is required for scanning of reflecting markers.

A further object of this invention is to provide a register marker detection system wherein light is projected directly onto the photo-receiver, resulting in a large electrical useful signal with a high signal-to-noise ratio and thus, simplified signal evaluation.

Other objects and advantages of the invention will be apparent from the following detailed description.

In accordance with the present invention, a printing machine having means for adjusting the circumferential, axial and diagonal register of its plurality of plate cylinders (on which are secured printing plates having register markers disposed thereon) is provided with a register marker detection system comprising at least one illuminating means disposed on one side of each plate for generating and projecting light to illuminate said register markers, at least one photo-detecting means disposed on the other side of each plate for periodically detecting said light projecting through the register markers as the cylinder rotates the printing plate and for generating measurement signals in response thereto, and circuit means connected to said photo-detecting means for generating signals to control said cylinder register adjustment means, said register markers comprising at least first and second accurate-register apertures, and said illuminating means and said photo-detecting means being positioned such that the light generated by said illuminating means is detected by said photo-detecting means after passing through said apertures.

BRIEF DESCRIPTION OF THE DRAWINGS

FIG. 1A is a side elevation of a plate cylinder having illuminating means disposed therewithin and wherein a photo-detecting means is disposed outside of the cylinder.

FIG. 1B is a side elevation of a plate cylinder having photo-detecting means disposed therewithin and wherein an illuminating means is disposed outside of the cylinder;

FIG. 2 is a plan view of the plate cylinder shown in FIG. 1A;

FIG. 3A is a plan view of a printing plate having two accurate-register apertures positioned on a side edge thereof;

FIG. 3B is a plan view of a printing plate having two accurate-register apertures positioned on the lead edge thereof;

FIG. 5 is a block schematic showing a first detailed embodiment of the circuit arrangement of FIG. 4;

FIG. 7 is a block schematic showing the generation of zero pulses from the pulse generator for the angle-offset plate cylinders of the printing units 2 through 4 of a multi-color printing machine;

FIG. 8 is a block schematic showing the basic structure of the peak level indicator;

FIG. 11 is a block schematic showing the basic structure of the circuit arrangement in conjunction with a four-quadrant position detector;

FIG. 12A is a plan view of a four-quadrant position detector;

FIG. 12B is a plan view of a duo-sensor position detector.

DESCRIPTION OF THE PREFERRED EMBODIMENT

Figure 4:
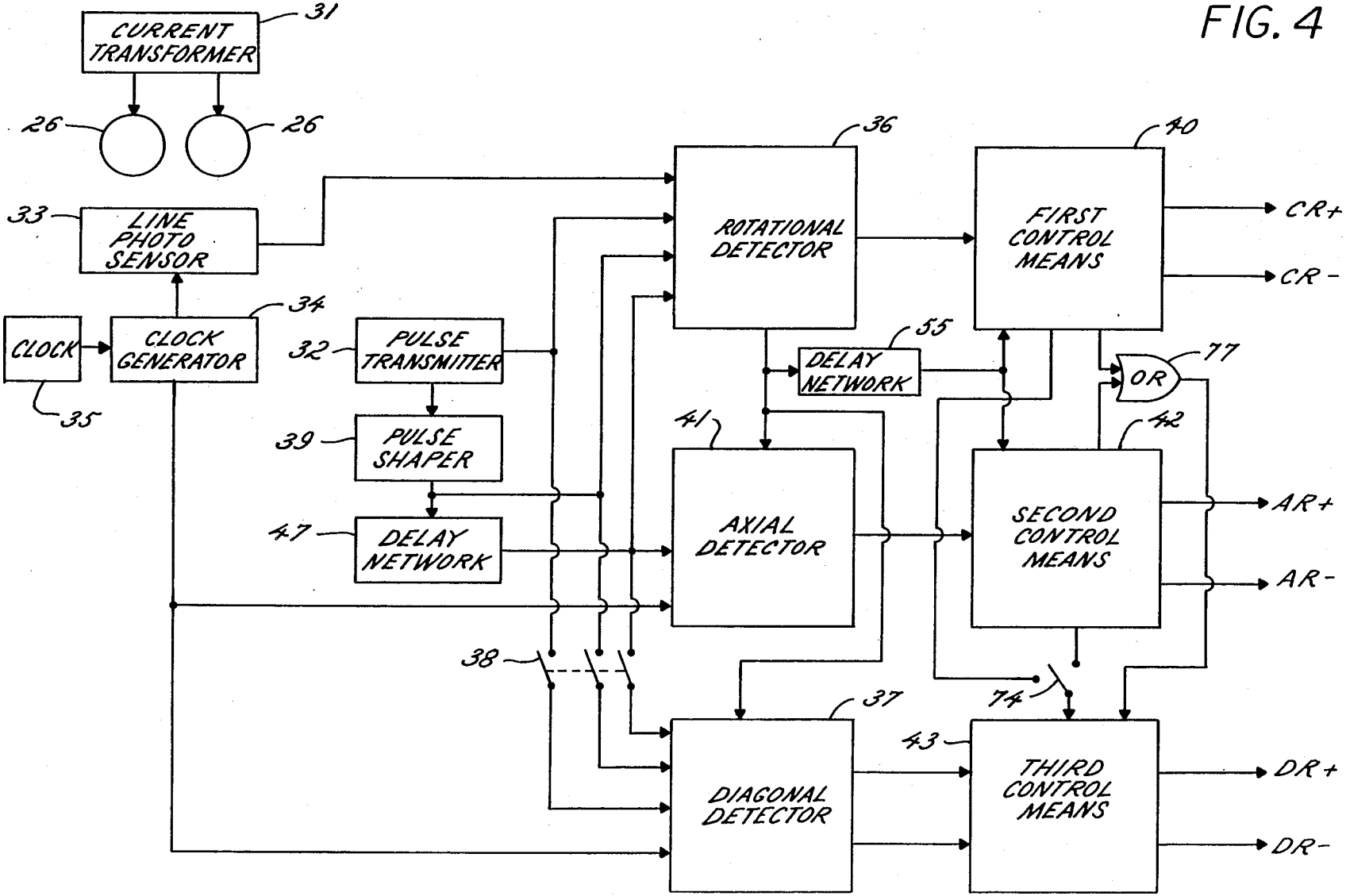
FIG. 4 is a block schematic showing the basic structure of the circuit arrangement in conjunction with line photo-sensors.

While the invention will be described in connection with certain preferred embodiments, it will be understood that it is not intended to limit the invention to these particular embodiments. On the contrary, it is intended to cover all alternatives, modifications, and equivalents as fall within the spirit and scope of the invention.

Turning now to the drawings and referring first to FIGS. 1A and 2, a plate cylinder 20 (having a channel or blank part 21 for receiving a plate lockup) is mounted on a shaft 22 for rotation and is rotationally driven by an appropriate drive means (not shown). Register adjusting motors and/or hydraulic or pneumatic register adjustment means (not shown inasmuch as such elements are well known in the art) are connected to the cylinder shaft 22 and respond to control signals to adjust the circumferential, axial and diagonal register of the cylinder. Moreover, a current transformer 31 for supplying power and a pulse transmitter 32 (with an additional trigger pulse) for generating pulse signals at predetermined rotational positions as the cylinder rotates are coupled to the shaft 22.

A printing plate 23 having at least two register markers (i.e., apertures 24, only one of which is shown) is roughly aligned and clamped on the plate cylinder 20. The apertures 24, which are preferably circular in form (but may alternatively be oval, rectangular, square or triangular), are disposed on the printing plate 23 in accurate-register outside of the printing and inking zone of the plate. As shown in FIGS. 3A and 3B, respectively, they may be disposed along a common side of the plate or along the leading edge 25 of the plate. It should be noted that the arrows in FIGS. 3A and 3B are intended to merely note the adjusting locations and adjusting means associated with the apertures.

In accordance with the present invention, each plate cylinder 20 is provided with a register marker detection system comprising at least one illuminating means and at least one photo-detecting means, said illuminating means and said photo-detecting means being positioned such that the light generated by the illuminating means is detected by the photo-detecting means after passing through the register aperture. As shown in the embodiment of FIG. 1A, an illuminating means comprising a photo-transmitter 26, an illuminating optical system 27 and a diffusion screen 28 is provided for each of the apertures 24 in the printing plate 23. Each of these illuminating means is disposed within, and rotates with, the plate cylinder 20, and generates and projects light to transilluminate the correspondingly arranged aperture 24. One photo-detecting means is disposed outside of the plate cylinder 20 and is fixed to the printing machine (not shown) when the printing plate 23 has the common-side aperture arrangement of FIG. 3A, while two such photo-detecting means are necessary when the printing plate has the leading-edge aperture arrangement of FIG. 3B. Each photo-detecting means comprises a position-sensitive photo-receiver 29 and an optical system 30. The photo-receiver 29 periodically detects light projecting through the corresponding register marker (i.e., aperture 24) as the cylinder 20 rotates the printing plate 23 and generates, in response, measurement signals representative of the circumferential, axial and diagonal position of the aperture. The optical system 30 serves to adapt the geometry of the corresponding aperture 24 to the dimensions of suitable commercial photo-receivers 29 comprising a plurality of photo-sensitive elements. It should be noted that the light markers formed by the accurate-register apertures 24 may be, for this purpose, adapted to the photo-receiver array in an optimum fine-stage graduation, and the subsequent display may also be adapted to a conventional scaling during the actual measurement.

FIG. 1B shows an alternate embodiment of the register marker detection elements in which the photo-detecting means is disposed within, and rotates with, the plate cylinder 20, and the illuminating means is disposed outside the plate cylinder and is fixed to the printing machine. In this embodiment, there is one photo-detecting means provided for each aperture 24, and either one or two illuminating means are provided depending upon whether the printing plate 23 has a common-side or leading-edge aperture arrangement.

In accordance with a further aspect of the present invention, a circuit means is connected to each photo-receiver 29, and responds to the pulse signals generated by the pulse transmitter 32 and the measurement signals generated by the photo-receiver 29 to generate the signals for controlling the cylinder register adjustment means. These circuit means may take a variety of forms, depending on the type of photo-receiver used.

Referring now to FIG. 4, a first embodiment of a photo-receiver and its associated circuit means is shown. In this embodiment of the present invention, each position-sensitive photo-receiver comprises a line photo-sensor 33 (also known as a CCD line recording IC) having a plurality of individual sensor elements (e.g., far in excess of 1000 photo-sensitive zones in line form) which are actuated by light and generate digital measurement signals in response. These individual sensor elements are triggered and switched by a clock generator 34 and a clock 35 with digital signals.

The light sources 26, to which power is supplied by the current transformer 31, are associated with the accurate-register apertures 24, as described previously. Upon rotation of the plate cylinder 20, the pulse transmitter 32 delivers counting pulses, which are distributed uniformly over the circumference, and which are fed to a rotational detector 36, and may be fed to a diagonal detector 37 via a triple switch 38. In addition, the pulse transmitter 32 delivers one individual pulse (which will hereinafter be referred to as the "zero pulse") per revolution of the plate cylinder 20. This may be set, for example, mechanically, as to be triggered at a time when the nominal start of the print of the plate cylinder 20 passes the position of the line photo-sensor 33; other reference points are also possible, however.

The front flank of the zero pulse is generated in a pulse shaper 39 to form a signal of short duration independent of the machine speed. The zero pulse is fed to the rotational detector 26, and may be fed to the diagonal detector 37 via the triple switch 38, and used, as will be described in greater detail below, to provide the preparation for a new measurement cycle.

The circuit means associated with the line photo-sensor 33 further comprises a rotational detector 36 for counting the number of pulse signals which occur between the generation of the zero pulse and the generation by the photo-sensor of the digital measurement signals in response to actuation by light transmitted through the first aperture; first control means 40 for comparing the pulse count from the rotational detector 36 with a predetermined rotational distance signal and generating signals to control the circumferential register adjustment means in response to this comparisonl; an axial detector 41 for detecting the respective individual sensor elements of the photo-sensor 33 which generated the digital measurement signal in response to actuation by light transmitted through the first aperture to determine the axial position of the first aperture; second control means 42 for comparing the determined axial position of the first aperture with a predetermined axial position signal and generating signals to control the axial register adjustment means in response to this comparison; a diagonal detector 37 for determining the position of the second aperture by using the digital measurement signal generated by the line photo-sensor 33 in response to the transmission of light through the second aperture; and third control means 43 for comparing the determined position of the second aperture with a predetermined position signal and generating signals to control the diagonal register adjustment means in response to this comparison.

Figure 6:
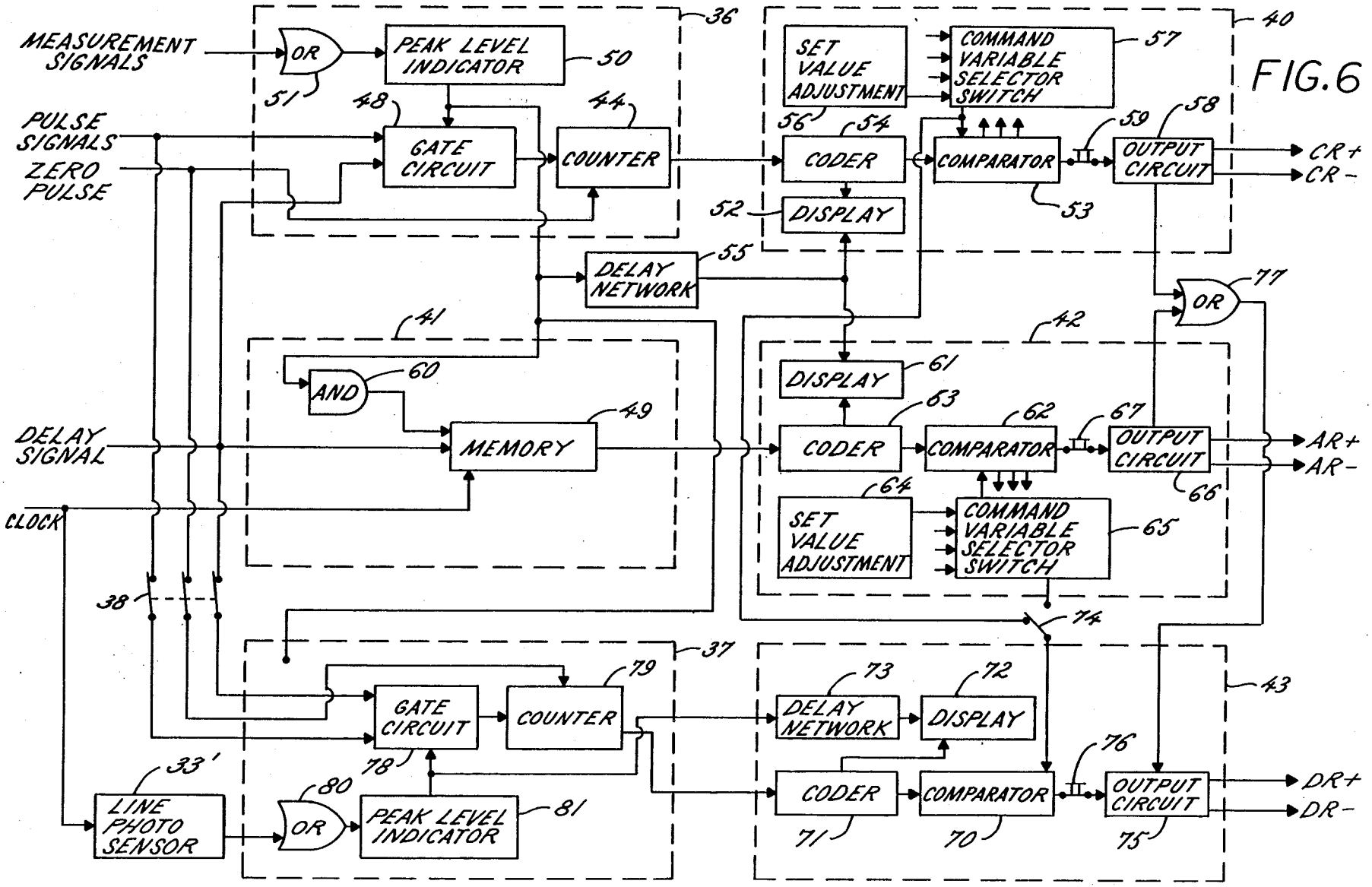
FIG. 6 is a block schematic showing a second detailed embodiment of the circuit arrangement of FIG. 4.

FIG. 5 shows further detail of the elements of the circuit means for the embodiment of the present invention when there is only one line photo sensor 33 (i.e., when the apertures 24 of the printing plate 23 are in the common-side arrangement of FIG. 3A), while FIG. 6 shows the detail when there are two line photo sensors 33, 33' (i.e., when the apertures 24 are in the leading-edge arrangement of FIG. 3B). It will be noted that for both embodiments, the rotational detector 36, first control means 40, the axial detector 41, second control means 42 and third control means 43 have the same configuration; only the diagonal detector 37 is altered.

With regard to the circuit means of FIG. 5, the zero pulse from the pulse shaper 39 resets a counter 44 and a preselection counter 45 to zero, and resets an electronic selector switch 46 to its basic position. A new measurement cycle begins when a delay signal generated by a delay network 47 (upon triggering by the zero pulse) opens a gate circuit 48 and sets a memory 49 to "memory ready". Thus the counting pulses from the pulse transmitter 32 pass, via the gate 48, to the counter 44 and the preselection counter 45, where they are added.

The gate circuit 48 is closed by a pulse signal which is triggered by a peak level indicator 50 in response to the measurement signals from the line photo sensor 33. An interconnected OR-gate 51 connects the individual sensor elements of the line photo sensor 33 to the common input of the peak level indicator 50. The peak level indicator is set to the "ready" position when the input signal from the OR-gate 51 exceeds a predetermined level to which a threshold switch 50A (see FIG. 8) is set. The still-rising input signal is then fed to a peak value memory 50B, which stores the still-rising maximum level at a low loss rate and applies the stored signal to one input of a compensator 50C. The signal from the OR-gate 51, the level of which does not fall until the line photo sensor 33 receives slightly less light through the rotating first aperture 24, is provided to a second input of the compensator 50C. When a voltage difference occurs at the two inputs of the compensator 50C (i.e., when the first aperture 24 illuminated by the light source 26 moves past the line photo sensor 33), it triggers the pulse signal which closes the gate 48.

Upon closing of the gate 48, the resulting pulse count (i.e., counter position) is representative of the distance covered by the circumference of the plate cylinder 20 at the preset adjustment from the nominal start of the print (when the zero pulse was triggered) to the first accurate-register aperture 24.

The pulse count is fed to a display 52 and a comparator 53, via a coder 54 if required. A delay network 55 provides a slight delay in the display 52 being taken into the memory, this operation being triggered by the output pulse signal of the peak level indicator 50. A predetermined rotational distance signal is input via a set value adjustment 56, and fed to the comparator 53 via a command variable selector switch 57. This switch 57 enables the command variable to be preset for other plate cylinders as well so that the entire printing machine can be run to the same circumferential register. The comparator 53 compares the pulse count with the predetermined rotational distance signal and generates a circumferential difference signal. An output circuit 58, which may be disconnected by an override switch 59, then receives the circumferential difference signal and, using it, generates circumferential register adjustment control signals CR+, CR− for controlling the plate cylinder's circumferential register adjustment means.

The clock signals used to trigger and switch the individual sensor elements of the line photo sensor 33 are fed to the memory 49. The "store" command is delivered to the memory 49 by an AND-gate 60 when it receives an input signal at its first input from the selector switch 46 (i.e., when the selector switch is in the basic position) and the trigger pulse from the peak level indicator 50 at its second input. Thus, a digital signal corresponding to the axial position of whichever individual sensor element of the line photo sensor 33 responded to the focused light beam transmitted through the first aperture 24 is stored in the memory 49.

This axial position signal is fed to a display 61 and a comparator 62, via a coder 63 if required. A set value adjustment 64 and command variable selector switch 65 function in a manner corresponding to their counterparts in the first control means to provide a predetermined axial position signal to the comparator 62. The comparator 62 generates an axial difference signal, which is fed to an output circuit 66. As in the first control means, the output circuit 66 may be disconnected by an override switch 67. The output circuit 66 uses the axial difference signal to generate axial register adjustment control signals AR+, AR− for controlling the axial register adjustment means.

The presetting of the preselection counter 45 is advantageously such that coincidence between it and the counter state occurs when the second aperture 24, which is disposed in the rear zone of the printing plate 23, is just in front of the line photo sensor 33. Upon this coincidence, the preselection counter 45 actuates the electronic switch 46, which, as a result, switches its output signal from the AND-gate 60 to an AND-gate 68 in the diagonal detector 37, and actuates a memory 69.

An output pulse is generated by the peak level indicator 50 in response to measurement signals generated by the line photo sensor 33 upon detection of light through the second aperture 24. This output pulse triggers the AND-gate 68 so that a digital signal corresponding to the individual sensor element of the line photo sensor 33 which responded to the focused light beam transmitted through the second aperture 24 (and representing the axial position of the second aperture) is stored in the memory 69.

The digital signal stored in the memory 69 is fed to a comparator 70, via a coder 71 if required, and to a display 72, although reception of the display is slightly delayed via a delay network 73. Comparator 70 receives the same predetermined axial position signal, via switch 74, as was used by comparator 62, compares it to the digital signal from the memory 69, and generates an axial difference signal for the second aperture.

An output circuit 75, which may be disconnected by an override switch 76, uses the second aperture axial difference signal to generate diagonal register adjustment control signals DR+, DR− for controlling the diagonal register adjustment means. It should be noted, however, that the output circuit 75 of the third control means 43 is actuated, via an OR-gate 77, only after there are no longer any control signals being output from either of the other output circuits 58, 66.

The circuit means for each of the plate cylinders of a printing machine are identical to those shown in FIG. 5, except that additional pulse transmitters can be dispensed with if, as shown in FIG. 7, a different preselection counter 45', 45'', 45''' is used for each additional plate cylinder 20 in a four-color machine. The number of preselection steps is so selected that the preselection counter signal is triggered when the nominal start of the print of each plate cylinder 20 passes the position of the associated line photosensor 33. The signals from the preselection counters 45', 45'', 45''' actuate the pulse shapers of the associated plate cylinder control units.

Referring now to FIG. 6, generation of the circumferential and axial register adjustment control signals (CR+, CR−, AR+, AR−) occurs in exactly the same manner as in the embodiment of FIG. 5. The diagonal register adjustment control signals (DR+, DR−) are generated differently, however, inasmuch as a second line photo sensor 33' is required to detect the second aperture 24 on the leading edge 25 of the printing plate 23. For this embodiment, the diagonal detector 37 has the same configuration (i.e., a gate circuit 78, counter 79, OR-gate 80, and peak level indicator 81), and works in exactly the same way, as the rotational detector 36. The triple switch 38 is closed so that the diagonal detector 37 receives the pulse signals from the pulse transmitter 32, the zero pulse from the pulse shaper 39 and the delay signal from the delay network 47. Thus, the diagonal detector 37 derives a pulse count corresponding to the actual rotational distance between the reference position (i.e., the position at which the zero pulse is generated) and the position at which detection of the second aperture 24 occurs.

The third control means then compares this pulse count with the predetermined rotational distance signal provided by the command variable selector switch 57 of the first control means 40 (via the switch 74), and generates diagonal register adjustment control signals DR+, DR− in response.

As an alternative to a line photo sensor, the position-sensitive photo-receiver may comprise a position detector which is actuated by light and generates, in response, analog measurement signals representative of the position of the aperture through which the light was transmitted. As is well known in the art, a position detector operates like a potentiometer receiving a current via the tapping contact. This current divides into two currents to the end contacts, with the difference between the currents corresponding to the position of the tapping, continuously and with high resolution. Such position detectors are conventionally available in various sizes and casings in the form of single-axis and two-axis position detectors.

Figure 9:
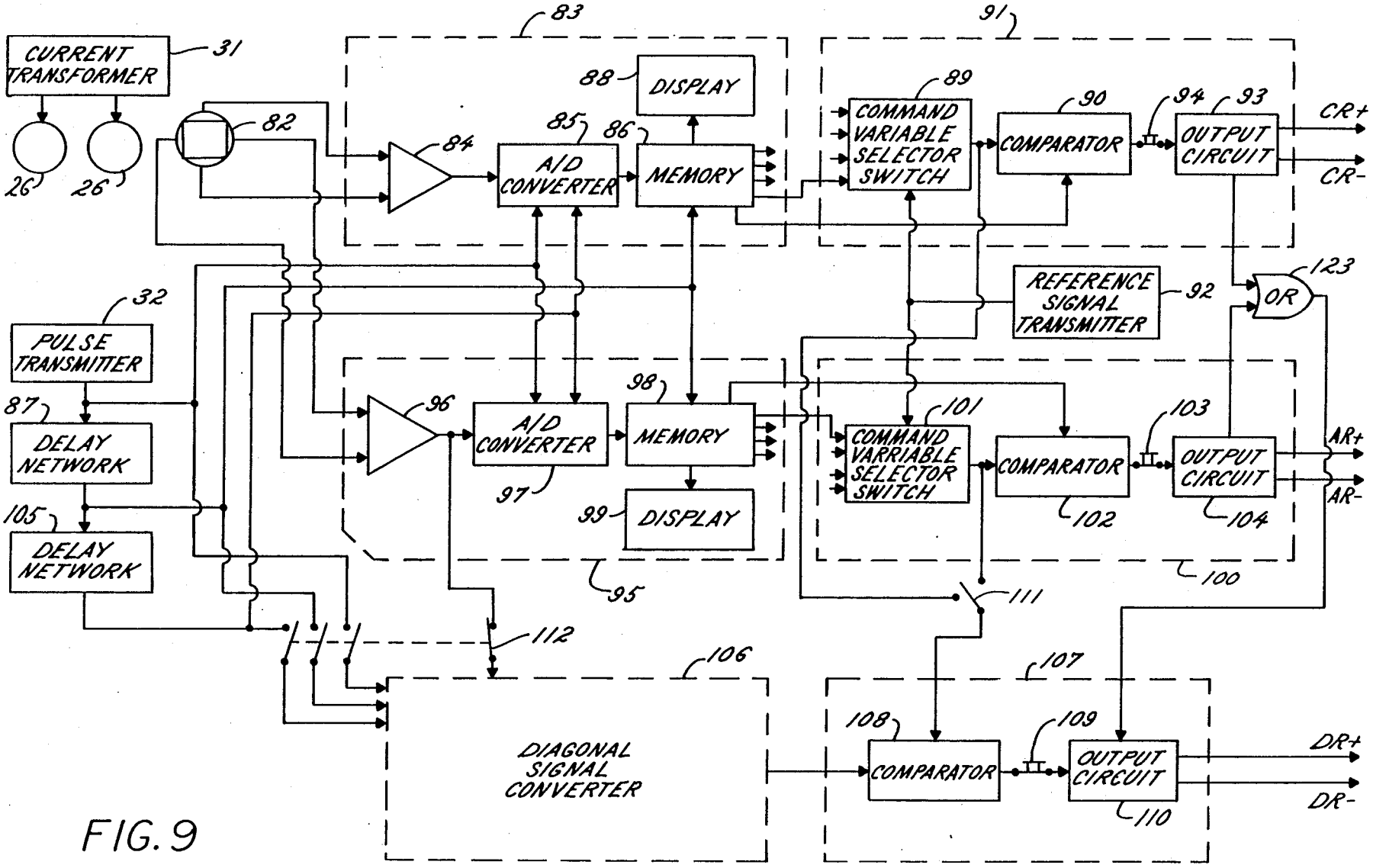
FIG. 9 is a block schematic showing detailed structure of the circuit arrangement in conjunction with position detectors.

Referring now to FIG. 9, the analog signals relevant to the circumferential register measurement are fed from a two-axis position detector 82 to a rotational signal converter 83. Specifically, the measurement signals are fed, via an amplifier 84 (which, as an option, delivers to the position detector 82 from its output signals as an evaluation unit a position-proportional output signal), to an analog-to-digital (A/D) converter 85 with sample and hold. A pulse transmitter 32, which can be adjusted to generate a trigger pulse at any predetermined cylinder angle, is so set that when the plate cylinder 20 is in the zero position in relation to the cylinder drive and the central position in relation to the printing cylinder, the trigger signal is generated when the center of the light source 26 rotating with the plate cylinder 20 is situated radially opposite the stationary position detector 82.

The A/D converter 85, in the "sample" state, is switched by the trigger signal from the pulse transmitter 32 to "hold", and delivers its digitized signal to a memory 86, which receives the signal with a slight delay via the delay network 87. The position of the aperture 24 stored in the memory 86 is displayed on a display 88 on the basis of a circumferential reference. Thus, the circumferential register adjustment can be completed manually in accordance with the display 88 by adjusting the plate cylinder 20 in relation to the drive in a well-known manner.

The contents of the memory 86 are also fed to a command variable selector switch 89 and a comparator 90 of a first control means 91. By means of the command variable selector switch 89, it is possible to preset a predetermined rotational signal having either a different value for each plate cylinder 20 or a signal level identical for all of the plate cylinders 20 (generated by a reference signal transmitter 92), such level advantageously corresponding to the printing plate basic setting. The comparator 90 compares the digital rotational position signal stored in the memory 86 with the predetermined rotational position signal and generates a circumferential difference signal. An output circuit 93, which can be disconnected via an override switch 94, receives the circumferential difference signal and, in response, generates circumferential register adjustment control signals CR+, CR−.

Measurement and display of the axial plate position and, if necessary, axial cylinder register adjustment, are effected in the same way described above using the same two-axis position sensor 82, an axial signal converter 95 (comprising an amplifier 96, A/D converter 97, memory 98 and display 99), and a second control means 100 (comprising a command variable selector switch 101, comparator 102, override switch 103 and output circuit 104).

It should be noted that once the position values have been taken over in synchronism by the A/D converters 85, 97 into the memories 86, 98, the A/D converters are reset to the "sample" state with a slight delay via the delay network 105, and thus, are ready for a new conversion.

Figure 10A:
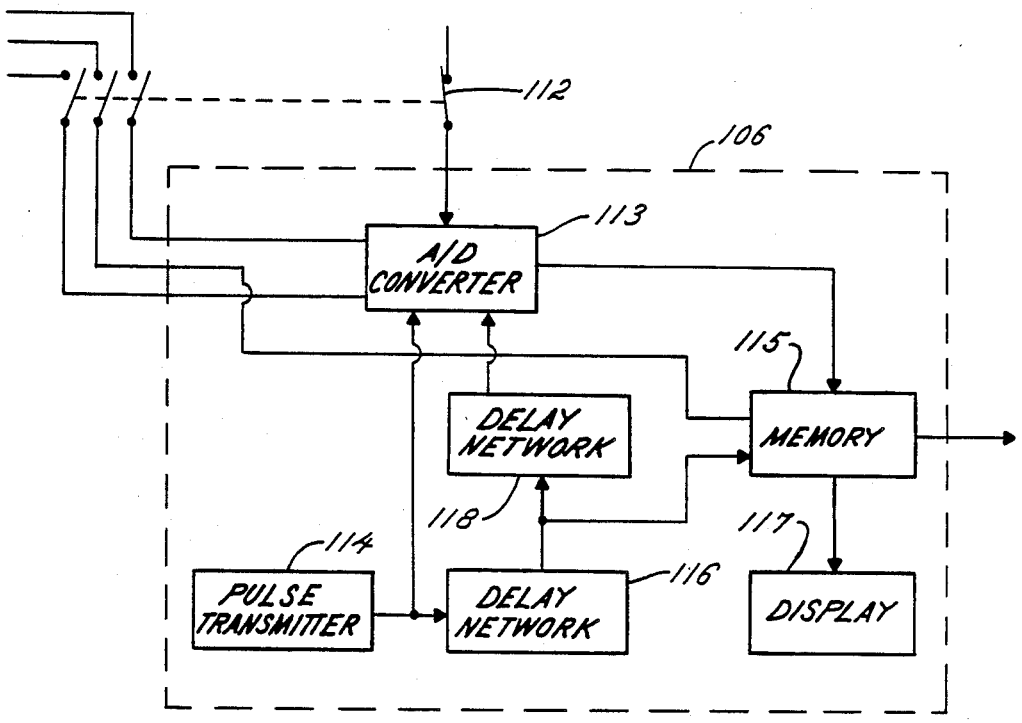
FIG. 10A is a block schematic showing a first detailed embodiment of the diagonal signal converter of FIG. 9.
Figure 10B:
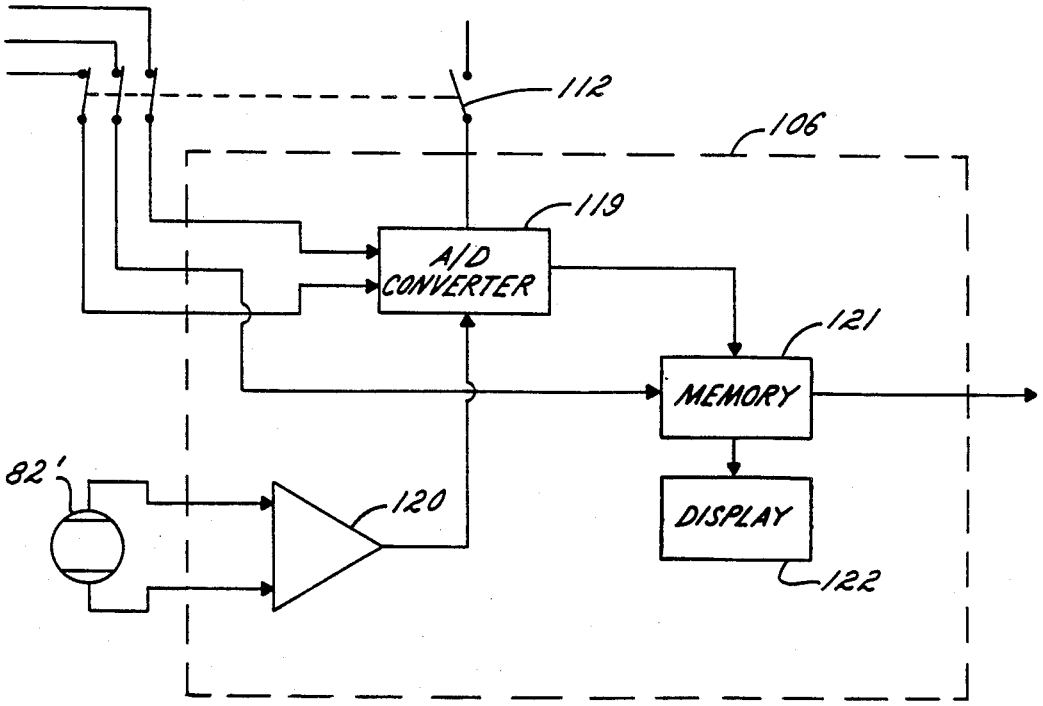
FIG. 10B is a block schematic showing a second detailed embodiment of the diagonal signal converter of FIG. 9.

As shown in FIGS. 10A and 10B, the diagonal signal converter 106 can take either of two configurations, depending on whether a printing plate 23 having a common-side or leading-edge aperture arrangement is being used. The third control means 107 (comprising a comparator 108, override switch 109 and output circuit 110), however, operates the same regardless of which aperture arrangement is being used, although different inputs, via switch 111, are used for the two different cases.

The embodiment of FIG. 10A is used when the printing plate 23 has a common-side aperture arrangement (i.e., when only one position detector 82 is necessary). A quadruple switch 112 is positioned so that an A/D converter 113 is connected to the output of the amplifier 96, and thus receives an analog axial measurement signal relating to the position of the second aperture 24. A pulse transmitter 114 is preset so that a pulse signal is generated when the center of the light source 26 is situated radially opposite the stationary position detector 82 and when the plate cylinder 20 is in the zero position in relation to the drive and in the central position in relation to the printing cylinder. This pulse signal switches the A/D converter 113 to the "hold" state. The digitized signal is stored in the memory 115 with a slight delay provided by the delay network 116, and is displayed in the display 117. The A/D converter 113 is reset to the "sample" state with a slight delay provided by the delay network 118, and thus, is ready for the next measuring cycle.

When a printing plate 23 having a leading-edge aperture arrangement is being used, a second one-axis position detector 82' is necessary. Accordingly, the embodiment of the diagonal signal converter 106 of FIG. 10B is used. The analog measurement signals from the position detector 82 are fed to an A/D converter 119 via an amplifier 120. The resulting digital diagonal position signal is stored in a memory 121 and displayed on a display 122. It will be noted that in this embodiment the switch 112 is positioned so that the A/D converter 119 and the memory 121 are controlled by the pulse transmitter 32 and the subsequent delay networks 87, 105.

Regardless of whether the embodiment of FIG. 10A or FIG. 10B is used, the output circuit 110 of the third control means 107 is blocked (and does not generate the diagonal register adjustment control signals DR+, DR−) by an OR-gate 123 if an adjustment signal is still being delivered by one or both of the other output circuits 93, 104.

A position detector of yet another type of construction is the four-quadrant position detector 124 shown in FIG. 12A. Its photo-sensitive surface, which is usually round, consists of four sector-shaped individual sensors 125 with little space between them, the apices meeting centrally in the center and being separated in the form of a cross by electrically insulating separator lines 126. With this, it is possible to determine which of the four sectors receives the focused light through an aperture 24 without accurate location detection. This is possible only in the center, because if light hits this point all four individual sensors 125 are illuminated equally so that the sum of all the output signals (a, a', b, b') becomes zero.

FIG. 11 shows a circuit means for use with a four-quadrant position detector. It should be noted that an identical circuit would be used for each of the three register adjustments. The signals of the two diametrically opposite sectors of the four-quadrant position detector 124 are amplified by amplifiers 127, 128 and then fed to comparators 129, 130. The latter comparator 130 has a close tolerance field, and its output to a memory 131 determines whether, and in what direction, there is a register error. The optical or acoustic displays 132, 133 are triggered accordingly, and the control signals (R+, R−) from the output circuit 134, which can be disconnected by the override switch 135, are actuated for plate cylinder adjustment. These signals consist of pulses which increase in intensity when the comparator 129 has been triggered by a greater input voltage difference. The output signals of the comparator 129 are taken into the memory 131 for pulse intensity control of the output circuit 134 and of the comparator 130 in order to trigger the directional pulses at the same output circuit 134 when a pulse transmitter 136 is triggered by a trigger pulse. The trigger pulses are set in accordance with the method already described hereinbefore.

As an example, let us assume that a beam of light incident off-center on the four-quadrant position detector 124 has equal components on the top and bottom sectors and thus generates an identical signal of difference zero at the outputs a and a'. Neither of the comparators 129, 130 is then triggered. Conditions are different between the outputs b and b' assuming that different sensor surfaces are illuminated. As a result of the differential signal, at least one comparator 129, 130 then responds and displays the direction of the register error, and also initiates the register correction with appropriate setting of the switch 135. Without accurate position determination being required beforehand, the movement of the adjustment drive is stopped when the ratio of the illuminated sensor surfaces determined by measuring the outputs a, a', b, b' is equal to one or the difference is equal to zero.

In the case where the printing plate 23 has a leading-edge aperture arrangement, one of the four-quadrant position detectors 124 can be replaced by a one-dimensional system, a duo-sensor 137 (see FIG. 12B). With this, the measurement is carried out at the rectilinear insulated separating line 138 between the two, usually right-angled, sensor elements 139.

Depending upon the design of the printing machine control system, the output signals of the output circuits may in known manner each comprise an electromechanical switch (a relay or contactor) or an electronic switching means (e.g., a semiconductor relay, thyristors, etc.) for switching a motor for clockwise or counterclockwise rotation, or alternatively they can be used to switch solenoid valves in the case of hydraulic or pneumatic register adjustment.

As can be seen from the foregoing detailed description, this invention provides an improved arrangement in a printing machine for detecting and adjusting the circumferential, axial and diagonal register of the plurality of plate cylinders. According to this invention, a register marker detection system is provided in which light is projected through apertures in the printing plates directly onto a photo-receiver, resulting in a large electrical useful signal and, therefore, simplified signal evaluation. Moreover, since light markers of constant brightness are scanned and evaluated in the dark surrounding field of the photo-receiver, the evaluation is independent of contrast and edge quality and, thus, greater scanning accuracy without increased expenditure over the previously known systems is possible.

We claim:

1. In a printing machine having means for adjusting the circumferential, axial and diagonal register of a plurality of plate cylinders on which printing plates are secured, wherein each plate cylinder is mounted on a shaft for rotation and each printing plate has register markers disposed thereon outside of its respective printing and inking zone, the improvement comprising:

a register marker detection system comprising at least one illuminating means disposed on one side of each plate for generating and projecting light to illuminate said register markers; at least one photo-detecting means disposed on the other side of each plate for periodically detecting said light projecting through the register markers as the cylinder rotates the printing plate and for generating measurement signals in response thereto; and circuit means connected to said photo-detecting means for generating signals to control said cylinder register adjustment means;

said register markers comprising at least first and second accurate-register apertures; said illuminating means and said photo-detecting means being positioned such that the light generated by said illuminating means is detected by said photo-detecting means after passing through said apertures; and said circuit means being responsive to said measurement signals from said photo-detecting means related to light passing through said apertures.

2. The apparatus of claim 1 wherein:

each illuminating means comprises a photo-transmitter;

each photo-detecting means comprises a position-sensitive photo-receiver;

a pulse transmitter is coupled to the shaft of said plate cylinder for generating pulse signals at predetermined rotational positions as said cylinder rotates; and said circuit means is responsive to said pulse signals and said measurement signals to generate said control signals.

3. The apparatus of claim 2 wherein each illuminating means further comprises an optical system and a diffusion screen and each photo-detecting means further comprises an optical system positioned to focus light detected through said apertures on said position-sensitive photo-receiver.

4. The apparatus of claim 2 wherein each aperture has an illuminating means associated therewith which is disposed within, and rotates with, said plate cylinder; and wherein each photo-detecting means is disposed outside said plate cylinder and is fixed to said printing machine.

5. The apparatus of claim 2 wherein each aperture has a photo-detecting means associated therewith which is disposed within, and rotates with, said plate cylinder; and wherein each illuminating means is disposed outside said plate cylinder and is fixed to said printing machine.

6. The apparatus of claim 1 wherein each accurate-register aperture is of a circular shape.

7. The apparatus of claim 2 wherein each position-sensitive photo-receiver comprises a line photo-sensor having a plurality of individual sensor elements which are actuated by light and generate digital measurement signals in response.

8. The apparatus of claim 7 wherein each circuit means comprises:

means for generating a reference signal when said plate cylinder is in a predetermined rotational reference position;

a rotational detector for counting the number of pulse signals which occur between the generation of said reference signal and the generation by said photo-sensor of said digital measurement signals in response to actuation by light transmitted through said first aperture, said pulse count corresponding to the actual rotational distance between the reference position and the position at which detection of the first aperture occurs;

first control means for comparing the first aperture pulse count with a predetermined rotational distance signal and generating signals to control the circumferential register adjustment means in response to said comparison;

an axial detector for detecting the respective individual sensor elements of the photo-sensor which generated said digital measurement signal in response to actuation by light transmitted through the first aperture to determine the axial position of the first aperture;

second control means for comparing the determined axial position of the first aperture with a predetermined axial position signal and generating signals to control the axial register adjustment means in response to said comparison;

a diagonal detector for determining the position of the second aperture by using the digital measurement signal generated in response to the transmission of light through the second aperture; and third control means for comparing the determined position of the second aperture with a predetermined position signal and generating signals to control the diagonal register adjustment means in response to said comparison.

9. The apparatus of claim 8 wherein:

said rotational detector comprises a counter which counts said pulse signals generated by said pulse transmitter, a gate circuit which is open and closed to control the transmission of said pulse signals to said counter, and a peak indicator which receives said digital measurement signals generated by said photo-sensor in response to actuation by light transmitted through said first aperture and generates a signal to close said gate circuit;

said reference signal generating means comprises a pulse shaper which, in response to the pulse signal generated by said pulse transmitter at said predetermined rotational reference position, generates said reference signal to open said gate circuit and set the value of said counter to zero when said plate cylinder is in said predetermined rotational reference position;

said first control means comprises a comparator for comparing the first aperture pulse count of said counter with said predetermined rotational distance signal and generating a circumferential difference signal, and an output circuit which receives said circumferential difference signal and generates in response said circumferential register adjustment control signals;

said axial detector comprises a memory for storing the digital measurement signal corresponding to the axial position of said first aperture; and said second control means comprises a comparator for comparing the digital information stored in the axial detector memory with said predetermined axial position signal and for generating an axial difference signal, and an output circuit which receives said axial difference signal and generates in response said axial register adjustment control signals.

10. The apparatus of claim 8 wherein said diagonal detector comprises:

means for detecting the respective individual sensor elements of the photo-sensor which generated said digital measurement signal in response to the transmission of light through the second aperture to determine the axial position of said second aperture; and said third control means compares the determined axial position of said second aperture with said predetermined axial position signal and generates said signals to control the diagonal register adjustment means in response to said comparison.

11. The apparatus of claim 10 wherein:

said detecting means comprises a memory for storing the digital measurement signal corresponding to the axial position of said second aperture; and said third control means comprises a comparator for comparing the digital information stored in the diagonal detector memory with said predetermined axial position signal and generating a second aperture axial difference signal, and an output circuit which receives said second aperture axial difference signal and generates in response said diagonal register adjustment control signals.

12. The apparatus of claim 8 wherein said diagonal detector comprises:

means for counting the number of pulse signals which occur between the generation of said reference signal and the generation by said photo-sensor of said digital measurement signal in response to actuation by light transmitted through said second aperture, said second aperture pulse count corresponding to the actual rotational distance between the reference position and the position at which detection of the second aperture occurs; and said third control means compares the second aperture pulse count with said predetermined rotational distance signal and generates said signals to control the diagonal register adjustment means in response to said comparison.

13. The apparatus of claim 12 wherein:

said counting means comprises a counter which counts said pulse signals generated by said pulse transmitter, a gate circuit which is open and closed to control the transmission of said pulse signals to said counter, and a peak indicator which receives said digital measurement signals generated by said photo-sensor in response to actuation by light transmitted through said second aperture and generates a signal to close said gate circuit;

said reference signal generating means comprises a pulse shaper which, in response to the pulse signal generated by said pulse transmitter at said predetermined rotational reference position, generates said reference signal to open said gate circuit and set the value of said counter to zero when said plate cylinder is in said predetermined rotational reference position;

said third control means comprises a comparator for comparing the pulse count of said counter with said predetermined rotational distance signal and for generating a second aperture circumferential difference signal, and an output circuit which receives said second aperture circumferential difference signal and generates in response said diagonal register adjustment control signals.

14. The apparatus of claim 2 wherein each position-sensitive photo-receiver comprises a position detector which is actuated by light and in response generates analog measurement signals representative of the position of the aperture through which the light was transmitted.

15. The apparatus of claim 14 wherein each circuit comprises:

a rotational signal converter for converting the analog measurement signal for the first aperture to a digital rotational position signal and storing said digital rotational position signal;

first control means for comparing the digital rotational position signal with a predetermined rotational signal and generating signals to control the circumferential register adjustment means in response to said comparison;

an axial signal converter for converting the analog measurement signal for the first aperture to a digital axial position signal and storing said digital axial position signal;

second control means for comparing the digital axial position signal with a predetermined axial signal and generating signals to control the axial register adjustment means in response to said comparison;

a diagonal signal converter for converting the analog measurement signal for the second aperture to a digital diagonal position signal and storing said digital diagonal position signal; and third control means for comparing the digital diagonal position signal with a predetermined position signal and generating signals to control the diagonal register adjustment means in response to said comparison.

16. The apparatus of claim 15 wherein:

said rotational signal converter and said axial signal converter each comprises an amplifier for receiving and amplifying the analog measurement signal from the position detector, an analog-to-digital converter with sample and hold which converts the amplified analog measurement signal for the first aperture to a digital position signal, said converter being switched from the sample state to the hold state upon receipt of a pulse signal from the pulse transmitter, and a memory for storing the digital position signal;

said first control means comprises a comparator for comparing said digital rotational position signal stored in the rotational signal converter memory with said predetermined rotational position signal and for generating a circumferential difference signal, and an output circuit which receives said circumferential difference signal and generates in response said circumferential register adjustment control signals; and said second control means comprises a comparator for comparing said digital axial position signal stored in the axial signal converter with said predetermined axial position signal and for generating an axial difference signal, and an output circuit which receives said axial difference signal and generates in response said axial register adjustment control signals.

17. The apparatus of claim 15 wherein:

said diagonal signal converter comprises a pulse transmitter for generating trigger pulses when the plate cylinder is in a predetermined position, an analog-to-digital converter with sample and hold which converts the analog measurement signal for the second aperture to said digital diagonal position signal, said converter being switched from the sample state to the hold state upon receipt of a trigger pulse from the pulse transmitter, and a memory for storing the digital diagonal position signal; and said third control means comprises a comparator for comparing said digital diagonal position signal stored in the diagonal signal converter memory with said predetermined axial position signal and for generating a diagonal difference signal, and an output circuit which receives said diagonal difference signal and generates in response said diagonal register adjustment control signals.

18. The apparatus of claim 15 wherein:

said diagonal signal converter comprises an amplifier for receiving and amplifying the analog measurement signal for the second aperture from the position detector, an analog-to digital converter with sample and hold which converts the amplified analog measurement signal for the second aperture to said digital diagonal position signal, said converter being switched from the sample state to the hold state upon receipt of a pulse signal from the pulse transmitter, and a memory for storing the digital diagonal position signal; and said third control means comprises a comparator for comparing said digital diagonal position signal stored in said diagonal signal converter memory with said predetermined rotational position signal and generating a diagonal difference signal; and an output circuit which receives said diagonal difference signal and generates in response said diagonal register adjustment control signals.

19. The apparatus of claim 2 wherein each position-sensitive photo receiver comprises a position detector having a photo-sensitive surface divided by electrically insulating separator lines into at least two sectors, each surface sector generating a measurement signal in response to illumination thereof through one of said apertures by light from the photo-transmitter.

20. The apparatus of claim 19 wherein a four-quadrant position detector having first and second pairs of diametrically opposed sectors is used to detect light transmitted through both of said first and second apertures, the measurement signals generated by said first and second pairs of diametrically opposed sectors in response to light transmitted through said first aperture being used to generate, respectively, said signals for controlling said circumferential and axial register adjustment means, and the measurement signals generated by one of said pairs of diametrically opposed sectors in response to light transmitted through said second aperture being used to generate said signals for controlling said diagonal register adjustment means.

21. The apparatus of claim 19 wherein:

a four-quadrant position detector having first and second pairs of diametrically opposed sectors is used to detect light transmitted through said first aperture, the measurement signals generated by said first and second pairs of diametrically opposed sectors being used to generate, respectively, said signals for controlling said circumferential and axial register adjustment means; and a duo-sensor position detector having two sectors is used to detect light transmitted through said second aperture, the measurement signals generated by said two sectors being used to generate said signals for controlling said diagonal register adjustment means.

* * * * *